United States Patent [19]

Bryant et al.

[11] 4,361,763

[45] Nov. 30, 1982

[54] SMOKE DETECTORS

[75] Inventors: Jack Bryant, Amersham; John H. Howes; Dennis W. S. Smout, both of Harwell, all of England

[73] Assignee: The Radiochemical Centre Limited, Buckinghamshire, England

[21] Appl. No.: 210,395

[22] Filed: Nov. 25, 1980

[30] Foreign Application Priority Data

Nov. 18, 1977 [GB] United Kingdom ..... 48154/77
Aug. 10, 1978 [GB] United Kingdom ..... 32913/78

[51] Int. Cl.[3] ..... H01J 47/02
[52] U.S. Cl. ..... 250/381; 250/385
[58] Field of Search ..... 250/381, 382, 384, 385; 340/629

[56] References Cited

U.S. PATENT DOCUMENTS 4,012,729 3/1977 Weaver et al. ..... 340/629
4,150,373 4/1979 Ried ..... 250/381
4,185,197 1/1980 Byrne ..... 250/381
4,286,160 8/1981 Ried ..... 250/381

*Primary Examiner*—Bruce C. Anderson
*Attorney, Agent, or Firm*—Wenderoth, Lind & Ponack

[57] ABSTRACT

A smoke sensing detector for use with an indicating device comprises a chamber adapted to allow smoke to pass therethrough, an inner electrode carrying a radioactive source, a collector electrode having one or more holes and mounted on the inner electrode by insulating pillars, and an outer electrode. The collector and outer electrodes define a first ionization region, and the collector and inner electrodes define a second or reference ionizaton region which is comparatively little affected by the passage of smoke. Mounting the collector electrode on the inner electrode reduces costs, is easy and ensures that, in the event of insulation failure, the device is fail safe.

10 Claims, 5 Drawing Figures

SMOKE DETECTORS

This is a continuation of application Ser. No. 959,773, filed Nov. 13, 1978.

BACKGROUND OF THE INVENTION

This invention relates to smoke detectors in which a radioactive substance is used in conjunction with two ionisation chambers. Smoke detectors of the kind envisaged include an outer electrode, a collector electrode, and an inner electrode made of or supporting a radioactive substance. The outer electrode and the collector electrode define between them an outer ionisation chamber adapted to allow smoke to enter from the surrounding atmosphere, and the collector electrode and the inner electrode define between them an inner ionisation chamber. The collector electrode has at least one hole capable of passing therethrough radiation emitted by the radioactive substance so as to produce ionisation simultaneously in both ionisation chambers. When a potential difference is maintained across the outer and inner electrodes, the collector electrode assumes an intermediate potential determined by the ratio of ionisation response caused by the radioactive substance in the two chambers. When smoke enters the outer chamber, this ratio, and the potential of the collector electrode, alters and this alteration of potential can be used e.g. to trigger an alarm.

Such detectors are known, and are described for example in British Patent Specification No. 1,280,304 of Hochiki Corporation. FIG. 1 of the accompanying drawings is an axial cross-section through one example of such a detector. An insulating support 10 carries a domed outer electrode 12, an annular collector electrode 14 with an axial hole 16, and a circular inner electrode 18 at the centre of the top face of which is mounted a radioactive substance 20. The outer electrode 12 is maintained at a potential of 9 volts relative to the inner electrode 18 via terminals 22 and 24 attached respectively to the outer and inner electrodes. The radioactive substance 20 emits radiation which causes ionisation of gas in both inner and outer ionisation chambers 26 and 28 respectively. Under the applied electric field, the ions migrate to the electrodes and cause an ion current, typically in the range $10^{-10}$ to $10^{-12}$ Amp, to pass. Under clean air conditions, the collector electrode 14 assumes a potential of, e.g., 5.5 volts. When smoke enters the outer ionisation chamber 28, the smoke particles absorb ions and are too large to migrate rapidly to the electrodes, so that the current is reduced until the potential of the collector has fallen to, e.g., 4.5 volts, the point at which the currents in the outer and inner chambers are again in balance. This fall in potential can be detected via terminal 30 by means of standard electronic circuitry such as a field effect transistor, and used to trigger an alarm.

In the device described by Hochiki Corporation, the only access to the inner ionisation chamber 26 is via the hole 16, which is made so small as substantially to prevent the ingress of smoke particles. This feature gives rise to a number of difficulties and disadvantages in design. The feature is also quite unnecessary, since the inner ionisation chamber can readily be designed so that the ion current is substantially unaffected by the ingress of smoke particles.

The detector is designed such that ions in the inner ionisation chamber are collected at the electrodes after only a short passage. Moreover the ions are collected rapidly because the electric field in the inner ionisation chamber is high, and the chamber operates under essentially saturated ion current conditions, that is to say, such that most of the ions produced by the ionising radiation in the chamber are collected at the electrodes; whereas the outer ionisation chamber 28 operates under unsaturated conditions.

SUMMARY OF THE INVENTION

It is an object of this invention to provide a smoke detector designed to take advantage of the fact that smoke particles can be allowed to enter freely what Hochiki Corporation called the inner ionisation chamber.

This invention provides a smoke sensing detector for use with an indicating device, such smoke detector comprising:

- a chamber adapted to allow smoke to pass therethrough;
- the base of the chamber forming a first electrode or inner electrode insulated from the remainder of the chamber, such remainder of the chamber forming a second electrode or outer electrode;
- the chamber having therein a third electrode or collector electrode serving to divide the chamber into two regions having different electrical characteristics when an appropriate potential difference is maintained across the inner and outer electrodes;
- a first ionisation region being formed by the outer electrode and the collector electrode and so constructed that the current which passes is significantly affected by ingress of smoke;
- and a second or reference ionization region being formed by the inner electrode and said collector electrode and so constructed that an essentially constant current passes and which current is little affected by ingress of smoke;
- the inner electrode supporting or incorporating a radioactive source;
- the collector electrode having one or more holes through which the rays from the radioactive material can pass, and
- the collector electrode being mounted on said inner electrode by the use of one or more pillars of an insulating material.

This design, in which the collector electrode is mounted on the inner electrode by means of pillars of insulating material has the following advantages:

(a) The simple form of the insulating pillars permits low cost manufacture and the use of desirable, but relatively expensive, insulating materials such as PTFE (polytetrafluoro ethylene). The corresponding portion of the Hochiki chamber would be very expensive when formed of PTFE.

(b) The ratio of surface area to length of these insulators can be favourable (the smaller the surface area, the less chance of leakage of electric current over the surface).

(c) If there is leakage along the insulators, the equipment will "fail safe" in that leakage will be to the inner electrode, and this will have, overall, the same effect as smoke.

(d) It is easy to mount the collector electrode precisely and rigidly in relation to the inner electrode, so as to obtain a correct and constant relationship between the ionising radiation distribution in the two ionisation regions, this it particularly true when the collector electrode is mounted on two or three or more pillars of insulating material.

(e) The design as a whole is well adapted to low cost manufacturing techniques.

In connection with (a), (b) and (c) above it should be noted that insulator failure is a common cause of failure in smoke detector ionisation chambers and the failure in some designs may not be in a "fail safe" mode.

BRIEF DESCRIPTION OF THE DRAWINGS

The invention is illustrated with reference to the accompanying drawings, in which.

DETAILED DESCRIPTION OF THE INVENTION

Figure 1:
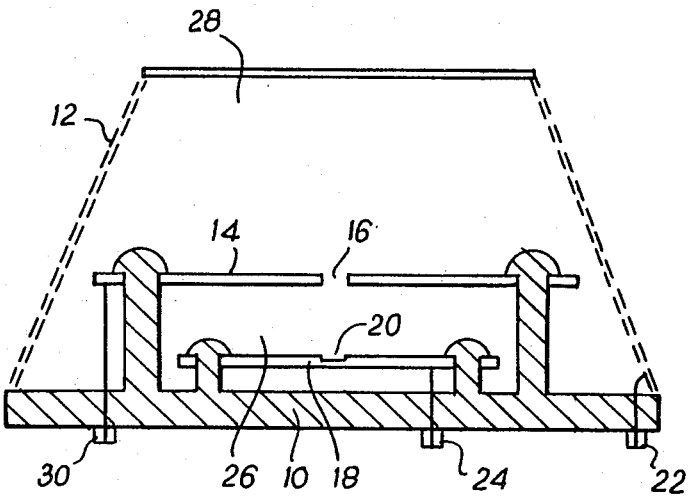
FIG. 1 PRIOR ART
FIG. 1 is an axial cross-section of a prior art smoke detector.

A first or inner electrode consists of a circular stainless steel disc having a flat outer portion 52 joined by a small perpendicular wall 54 to a flat inner portion 56 the centre of which is dished at 58 to receive a radioactive source 60; and a circular cover disc, also of stainless steel, having a circumferential skirt 64 which is a press fit over the wall 54, a flat portion 66 to overlie the edges of the radioactive source 60 and thereby retain it in position, and a small central hole 68 to permit radioactive emission. The electrode is provided with a lead 70 for electrical connection.

Mounted on the inner electrode by means of three PTFE pillars 72 is a collector electrode 74 in the form of a generally circular stainless steel plate with a recessed central portion 76 surrounding a central hole 78 divided in half by a bar 80. The shape of the collector electrode and particularly the central hole is discussed in more detail below. A sector of the collector electrode 74 is cut away at 82 and a lead 84 for electrical connection passes through the inner electrode 52 within a PTFE insulating block 86.

The circular outer edge of the disc 52 is embedded at 88 in an annular block 90 of insulating polypropylene material which also supports an outer electrode 92 and has two slits 94 for leads 96 for electrical connection to the outer electrode. The outer electrode 92 is of conventional design being a circular domed stainless steel casing whose sloping sides 98 have apertures adequate to permit free flow of air and smoke into and out of the chamber, in which the first ionisation region is shown as 100 and the second or reference ionisation region is shown as 102.

The outer electrode 92, collector electrode 74 and inner electrode 52 are provided with terminals 96, 84 and 70 respectively on the reverse side of the block 90 which are tinned for connection to the electronic circuitry. A potential difference of 9 volts is maintained between terminals 96 and 70.

The detector may be mounted on a printed circuit board (not shown) with holes to permit the terminals 96, 84 and 70 and the insulating block 86 to pass through.

The radioactive material is Americium 241 carried on a metallic foil with a 2 micron protective layer of gold. The activity of the source visible through the hole 68 is 0.4 microCuries. The major dimensions of the detector are as follows:

| | |
|---|---|
| Diameter of the hole 68 | 3 mm |
| Diameter of the hole 78 | 10 mm |
| Width of bar 80 | 1 mm |
| Height of outer electrode 92 above radioactive source 60 | 15 mm |
| Overall diameter of outer electrode 92 | 40 mm |

The operation of this detector is as that previously described with reference to FIG. 1.

Figure 5:
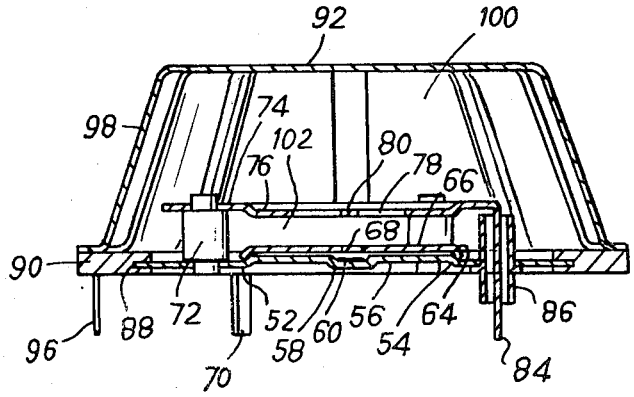
FIG. 5 is a section on line 5—5 of FIG. 4, with the outer electrode being also included.

A preferred and subsidiary feature of this invention relates to the design of the collector electrode. The requirements that the second or reference ionisation region operate under substantially saturated ion current conditions and that the first ionisation region operate under substantially unsaturated ion current conditions determine to a large extent the dimensions of the detector. Referring back to FIG. 5 of the accompanying drawings, when the radioactive substance is an $\alpha$-particle emitter, the reference ionisation region needs to be quite small, and the distance between the radioactive substance 60 and the hole 78 in the collector electrode may typically be about 2.5 mm. In mass production, the operation of mounting the radioactive substance 60 on the inner electrode at 58 is a tricky one, and it is not easily possible to keep dimensions precisely the same from one detector to the next. Consider the case where the radioactive substance 60 has been positioned too far from the hole 78, say 2.6 mm instead of 2.5 mm. The ratio of ionisation response in the first and second regions will be too low, so the potential of the collector electrode 74 will be too low, e.g. 4.8 volts instead of 5.5 volts, and the detector will be too sensitive and may trigger an alarm, e.g. as the result of natural fluctuations in the production of ions in the chambers, in the absence of any smoke. Conversely, a detector in which the radioactive substance 60 has been positioned too close to the hole 78 will be relatively insensitive or even ineffective.

According to a preferred feature of this invention, the collector electrode is so shaped that the ratio of currents produced by ionisation in the first and second ionisation regions is substantially independent of the position of the radioactive source relative to the collector electrode.

For a given radioactive substance and design of detector, there will be an optimum position of the radioactive source relative to the collector electrode, and specifically an optimum distance of the radioactive source from the collector electrode. This optimum will be aimed at, but not always precisely achieved, during manufacture. We envisage a design in which a 5%, desirably 10%, preferably 20%, manufacturing error in the distance between the radioactive source and the collector electrode alters the collector current potential by less than 20%, desirably less than 10%, preferably less than 5% of the alteration caused by standard smoke from a burning wood fire at a density of 0.5 d B/m according to Clause 20 of British Standard 5446: Part 1L 1977 (Components of automatic fire alarm systems for residential premises). We envisage similar tolerances for other manufacturing variations such as failure to properly align the collector electrode with the inner electrode, though these are less likely to be important in practice.

Generally, the detector will be designed to trigger an alarm when the smoke density reaches a predetermined value in the range 0.05–0.5 d B/m (Appendix D of B.S. 5446: Part 1). Desirably this initial smoke density will cause alteration of the potential of the collector electrode of at least 1 volt, preferably at least 1.5 volts, when the outer and inner electrodes are maintained at a potential difference of 9 volts. Preferably the percentage manufacturing errors noted above will alter the potential of the collector electrode under described conditions by less than 0.2 volts, particularly less than 0.1 volts.

Figure 2:
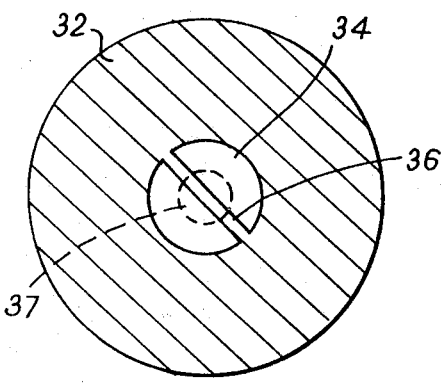
FIGS. 2 and 3 are cross-sections of two collector electrodes employable in the smoke detector of the invention.
Figure 3:
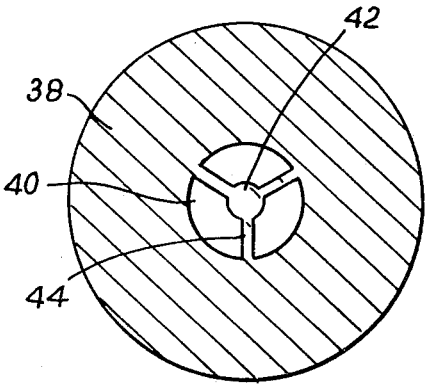
Figure 4:
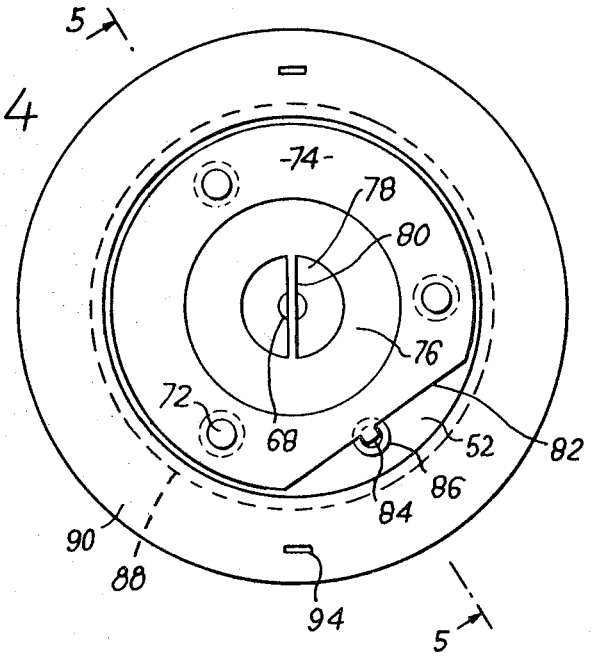
FIG. 4 is a plan view of a detector with the outer electrode omitted for clarity.

FIGS. 2 and 3 are plan views of two collector electrodes shaped according to this invention, the radioactive source being shown dotted in the background. Other shapes than those illustrated may be used, as will be apparent to those skilled in the art.

In FIG. 2, a circular collector electrode 32 has a central hole 34 divided in half by bar 36. The radioactive source is shown dotted as 37. For use with a 3 mm diameter radioactive source positioned 2.5 mm away, we prefer a 1 cm diameter hole 34 divided by a 1 mm wide bar 36.

In FIG. 3, a circular collector electrode 38 has an annular hole 40 and a circular centrepiece 42 supported by three radial struts 44. For use with a 2 mm diameter radioactive source positioned 2.5 mm away, we prefer a 1.6 cm diameter hole 40 and a 2 mm diameter centrepiece 42 supported by struts 44 which are as thin as possible consistent with adequate strength.

We have developed a computer programme by which we can calculate the ratio of ionisation produced in the first and second ionising regions for any particular design of detector. By this means, we calculate that, using the collector electrode of FIG. 3, the radioactive source could be positioned at any distance from 2.0 mm to 3.0 mm without significantly affecting the ratio of ionisation produced; and that, using the collector electrode of FIG. 2, the radioactive source could be positioned at any distance from 2.4 mm to 2.6 mm without significantly affecting the ratio of ionisation produced.

If the hole (34 in FIG. 2, 40 in FIG. 3) is too small, then an excessive proportion of the ionisation will take place in the reference region. If the hole is too large, an excessive proportion of the ionisation will take place in the first region and also too many ions will pass through the hole missing the collector electrode which will accordingly become less sensitive to changes in the ion current. If the bar (36, FIG. 2) or centrepiece (42, FIG. 3) is too large, too little ionisation will be produced in the first region; if too small, little compensating effect will result. Another design factor that needs to be borne in mind is that the ratio of the ionisation produced in the first and second ionisation regions must be large enough to permit a satisfactory operating potential for the detector. The design of FIG. 2 is preferred in this regard.

The strength of the radioactive source should be as low as possible consistent with generating a steady measurable ion current. If the radioactive source is too weak, the potential of the collector electrode is liable to wobble about its mean value, with the risk that the alarm may be triggered when there is no fire. We prefer to use from 0.01 to 10, particularly from 0.1 to 1, microCuries of radioactive material. α-Particle sources are conventionally provided in the form of a foil with a thin surface layer of gold to provide abrasion and corrosion resistance. The protective layer does, however absorb some of the radiation energy, typically, when using Americium 241 as the radioactive material, 20% of the energy of α-particles emerging at 90° angle to the surface of the foil and an increasing percentage as the angle of emergence decreases. It follows that α-particles emitted at high angles to the surface of the foil travel further than those emitted at low angles and are principally responsible for causing ionisation in the first ionisation region. To minimise the pressure dependence of the detector, it is preferred that the distance of the outer electrode from the radioactive source be not more than half the mean range of the α-particles in clean air at standard temperature and pressure.

For some radioactive sources emitting ionising radiations, for example, β-particles, conversion electrons, auger electrons or X-rays as well as α-particles, it may be possible to cover the one or more holes in the collector electrode with a membrane thin enough to permit the radiation to pass.

The detectors of this invention may be designed according to known criteria: to minimise the effect of variations of atmospheric pressure and temperature; to trigger an alarm at a predetermined elevated temperature even in the absence of smoke; to enable it to be tested without the use of smoke; to prevent the emission of radiation into the surrounding atmosphere. Electronic circuitry for use with such detectors is well known and will not be described here.

We claim:

1. A smoke sensing detector for use with an indicating device, said smoke sensing detector comprising:

a chamber defining means for defining a chamber adapted for allowing smoke to pass therethrough;

an inner electrode forming the base of said chamber defining means and an outer electrode forming the remainder of said chamber defining means, said inner electrode being insulated from said remainder of said chamber defining means;

a collector electrode positioned within said chamber for dividing said chamber into two regions capable of having different electrical characteristics when a potential difference is applied across said inner and outer electrodes, said two regions being a first ionization region defined by said outer electrode and said collector electrode for having a current passing therethrough which is affected by smoke entering therein, and a second ionization region defined by said inner electrode and said collector electrode for having a substantially constant current passing therethrough which is substantially unaffected by smoke entering therein relative to said current in said first ionization region;

said inner electrode comprising a radioactive source means, and said collector electrode having at least one hole for allowing radiation from said radioactive source means to pass therethrough; and a plurality of separate and spaced insulating pillars made of insulating material and mounted on said inner electrode and having said collector electrode mounted thereon, such that said collector electrode is insulated from and supported on said inner electrode, said insulating pillars being physically isolated in such a way that, on failure of the detector in service by insulation failure, leakage current from said collector electrode is able to flow only to said inner electrode and not to said outer electrode.

2. A detector as claimed in claim 1, wherein said collector electrode has a configuration such that the ratio of current produced by ionization in said first and second ionization regions is substantially independent of the position of said radioactive source means relative to said collector electrode.

3. A detector as claimed in claim 2, wherein said hole in said collector electrode comprises an annular hole and a solid circular centerpiece supported by radial struts, said radioactive source means being positioned on said inner electrode centrally opposite said hole.

4. A detector as claimed in claim 2, wherein said at least one hole in said collector electrode comprises a circular hole having a bar thereacross which divides said hole in half, and said circular hole being centrally positioned in said collector electrode and opposite said radioactive source means.

5. A detector as claimed in claim 1, wherein said radioactive source means comprises an independent radioactive source supported on said inner electrode.

6. A detector as claimed in claim 1, wherein said radioactive source means comprises said inner electrode.

7. A detector as claimed in claim 1, wherein said radioactive source means comprises an alpha-particle source having an activity of from 0.1 to 1 microCurie.

8. A detector as claimed in claim 1, wherein said radioactive source means emits alpha-particles, beta-particles, conversion electrons, auger electrons or X-rays.

9. In a smoke sensing detector for use with an indicating device, said smoke sensing detector being of the type having a chamber adapted to allow smoke to pass therethrough, an inner electrode forming the base of said chamber, an outer electrode forming the remainder of said chamber being insulated from said inner electrode, and a collector electrode positioned within said chamber and dividing said chamber into a first ionization region and a second ionization region in combination with said outer and inner electrodes, respectively, such that when a potential difference is applied across said inner and outer electrodes said first and second ionization regions have different electrical characteristics, whereby smoke entering said regions substantially affects a current passing through said first region while not affecting a current passing through said second region, said inner electrode supporting or being formed of a radioactive material, and said collector electrode having therein at least one hole for allowing radiation from said radioactive material to pass therethrough, the improvement comprising:

a plurality of separate and spaced insulating pillars formed of insulating material and mounted on said inner electrode and having said collector electrode mounted thereon, such that said collector electrode is insulated from and supported on said inner electrode, said insulating pillars being physically isolated in such a way that, on failure of the detector in service by insulation failure, leakage current from said collector electrode is able to flow only to said inner electrode and not to said outer electrode.

10. A detector as claimed in claim 1 or claim 9, wherein said plurality of insulating pillars comprises three pillars made of polytetrafluoro ethylene.

* * * * *